US012104880B2

(12) United States Patent
Chester

(10) Patent No.: US 12,104,880 B2
(45) Date of Patent: Oct. 1, 2024

(54) ADJUSTABLE RISER MOUNT FOR OPTICS

(71) Applicant: Outlander LLC, Garden City, ID (US)

(72) Inventor: Roy Chester, Boise, ID (US)

(73) Assignee: Outlander LLC, Garden City, ID (US)

( * ) Notice: Subject to any disclaimer, the term of this patent is extended or adjusted under 35 U.S.C. 154(b) by 1 day.

(21) Appl. No.: 17/973,597

(22) Filed: Oct. 26, 2022

(65) Prior Publication Data

US 2023/0213316 A1 Jul. 6, 2023

Related U.S. Application Data

(60) Provisional application No. 63/272,460, filed on Oct. 27, 2021.

(51) Int. Cl.
*F41C 23/14* (2006.01)
*F41C 23/16* (2006.01)
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 3,406,455 A * 10/1968 Akin, Jr. ..... F41G 11/005 248/316.6
5,787,630 A * 8/1998 Martel ..... F41G 11/003 42/127
5,806,228 A * 9/1998 Martel ..... F41G 11/003 42/124
6,295,754 B1 * 10/2001 Otteman ..... F41G 11/003 42/111
8,327,574 B2 * 12/2012 Sandler ..... F41G 11/003 42/126
8,528,140 B1 * 9/2013 Phillips ..... F41G 11/003 12/111
10,663,256 B1 * 5/2020 Garbouchian ..... F41G 1/425
2001/0045046 A1 * 11/2001 Otteman ..... F41G 1/38 42/136
2016/0377385 A1 * 12/2016 Culp ..... F41G 11/003 42/126
2023/0112612 A1 * 4/2023 Lee ..... F41G 11/001 42/125

* cited by examiner

*Primary Examiner* — Michelle Clement
(74) *Attorney, Agent, or Firm* — Banner & Witcoff, Ltd.

(57) ABSTRACT

An adjustable mount for a picatinny rail on a firearm, where the mount includes a vertically adjustable riser that will permit the mounted optic to co-witness with the back-up iron sights on the firearm.

19 Claims, 5 Drawing Sheets

ADJUSTABLE RISER MOUNT FOR OPTICS

CROSS REFERENCE TO RELATED APPLICATION

This application claims the benefit of U.S. Provisional Application No. 63/272,460 filed Oct. 27, 2021, which is incorporated herein by reference in its entirety.

TECHNICAL FIELD

This disclosure relates to the field of firearm optics mounting systems. The disclosure particularly relates to a novel mounting system that includes a vertically adjustable riser that allows adjustment of the mounted firearm optic in a vertical plane.

BACKGROUND

Conventional weapon and firearm optic mounting systems typically attach to the top of a firearm. In general, the mounting system is affixed in a position that is immovable. The optic system may be attached to the prior art mounting systems or may be integral to these mounting systems. It is desirable to co-witness the optic with back-up iron sights in the event the optic fails or is damaged. Co-witnessing the optic with the back-up sights typically involves adjusting the holographic aiming point of the optic to a position that is aligned with the back-up sights. This technique is time consuming and difficult. The system disclosed herein alleviates the problems associated with the adjustment of prior art systems by providing a riser that is adjustable in a vertical plane to easily align modern optic systems with back-up sights on the firearm.

SUMMARY

This Summary introduces a selection of concepts relating to this technology in a simplified form as a prelude to the Detailed Description that follows. This Summary is not intended to identify key or essential features.

In some aspects, a riser mount system is disclosed that may include a mount that may be configured to engage a picatinny rail, a riser that may be movably engaged with the mount. In some examples, the riser may be configured to adjust vertically, and the adapter plate may be affixed to the riser. In other examples, the adapter plate may be configured to removably engage an optic. In still other examples, the mount may further include a base, and a first and second sidewall positioned perpendicular to the base. In some examples, the first and second sidewalls may include a first plurality of teeth. In another example, the riser may further include a second plurality of teeth configured to engage the mount to the first plurality of teeth. In yet other examples, the riser, the mount, or the adapter plate may be a polymer, a metal, an alloy, or combinations thereof. In yet other examples, the riser, the mount, or the adapter plate may be 7075 aircraft aluminum. In still other examples, a firearm optic may be configured to removably engage the adapter plate.

In other examples, the adapter plate may be a unique adapter plate that is configured to be compatible with a variety of different optic types.

In other aspects, an adjustable riser is disclosed that may include an adapter plate that may be configured to removably engage an optic, and a riser base that may be configured to movably engage a mount. In some examples, the adapter plate may be affixed to the riser base, and the adapter plate may be positioned perpendicular to the riser base. In another example, the riser base may be configured to movably adjust in a vertical plane. In yet other examples, the adapter plate or the riser base may be a polymer, a metal, an alloy, or combinations thereof. In still other examples, the adapter plate or the riser base may be 7075 aircraft aluminum. In certain examples, the riser base may include a plurality of teeth configured to engage the mount. In yet other examples, the mount may further include a plurality of grooves configured to engage the riser base plurality of teeth.

In still other aspects, a method of forming a riser mount system is disclosed that may include the steps of forming a mount that may include a first plurality of teeth, forming a riser that may include a second plurality of teeth, and forming an adapter plate that may be affixed to the riser. In some examples, the mount may be configured to engage a picatinny rail, and the adapter plate may be configured to removably engage an optic. In other examples, the first plurality of teeth may be configured to removably engage the second plurality of teeth. In certain examples, the riser may be configured to adjust vertically. In other examples, the mount, the riser, or the adapter plate may be formed of a polymer, a metal, an alloy, or combinations thereof.

These and other features, advantages, and objects of the present disclosure will be further understood and appreciated by those skilled in the art by reference to the following specification, claims, and appended drawings, where various embodiments of the design illustrate how concepts of this disclosure may be used.

BRIEF DESCRIPTION OF THE DRAWINGS

A more complete understanding of features described herein and advantages thereof may be acquired by referring to the following description in consideration of the accompanying drawings, in which like reference numbers indicate like features.

DETAILED DESCRIPTION

In the following description of the various embodiments, reference is made to the accompanying drawings identified above and which form a part hereof, and in which is shown by way of illustration various embodiments in which features described herein may be practiced. It is to be understood that other embodiments may be utilized and structural and functional modifications may be made without departing from the scope described herein. Various features are capable of other embodiments and of being practiced or being carried out in various different ways.

Conventional riser block systems for the mounting of optics on firearms typically include a mount base with a clamp for securing the device to a firearm and a riser to elevate an optic attached to the top of the riser. The riser block elevates a firearm optic that may be in a better position for a shooter's comfort or other personal preference. These prior art devices, however, are limited to a single height change for the optic. A chosen riser block may elevate an optic too much in certain instances. In contrast, if the shooter desires that the optic be raised further, the shooter has the option of purchasing a riser block with a greater height, or modifying the existing system with adapter plates to elevate the optic. Further, a shooter may want to change optics or use multiple optics on a single firearm. The different optics may require different aiming profiles and a single, fixed-height riser block may not be compatible with multiple optics. The adjustable riser mount disclosed herein eliminates the problems with prior art systems. The riser disclosed herein includes a novel vertical/height adjustment system offering a shooter multiple positions to elevate an optic. Further, the riser may include a novel adapter plate affixed to the riser that is compatible with a variety of optic types.

Figure 1:
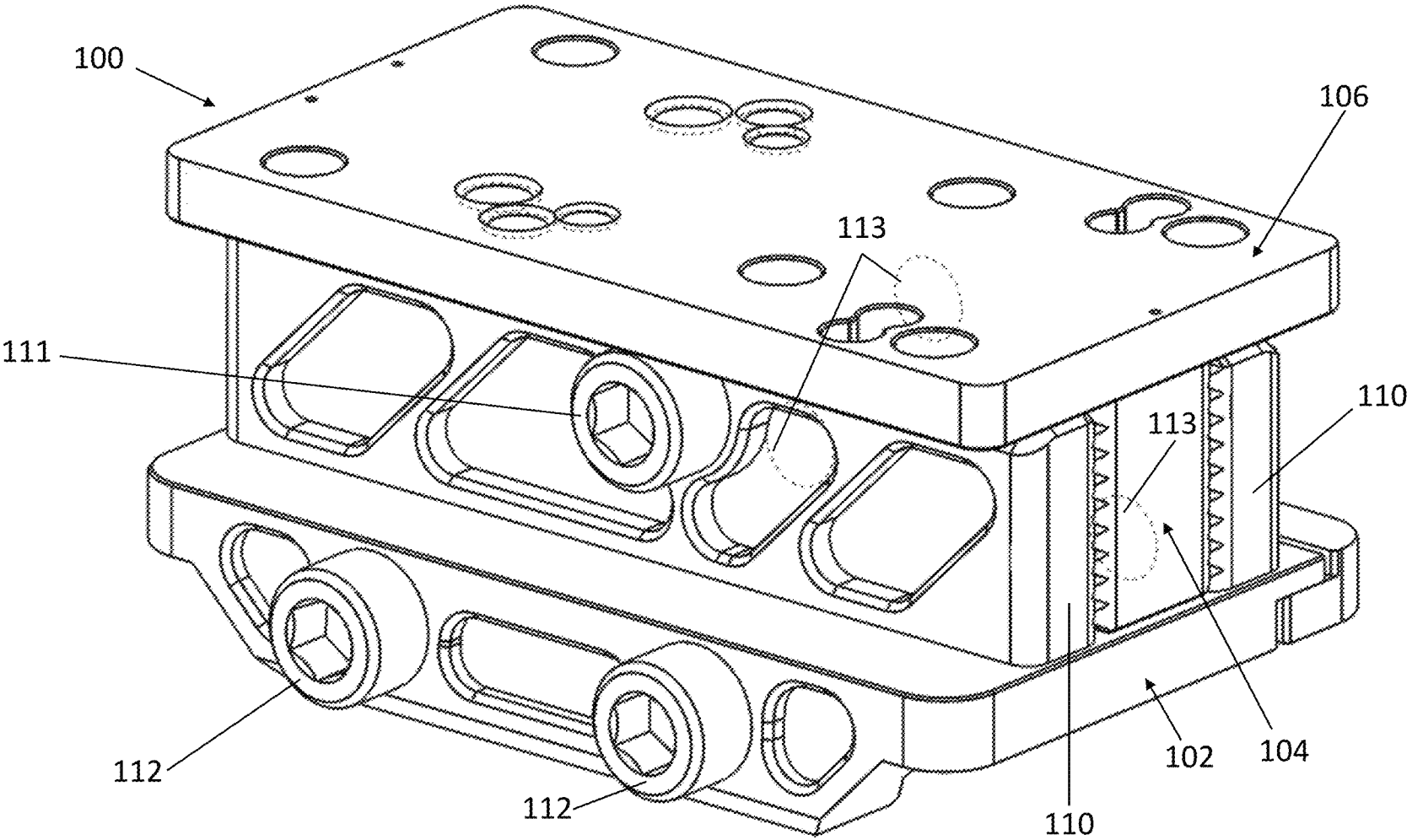
FIG. 1 is a front-right perspective view of an adjustable riser mount system disclosed herein.

FIG. 1 illustrates a front-right perspective view of an example adjustable riser mount system 100 disclosed herein. The system 100 may include a mount 102, a riser 104, and an adapter plate 106. The mount 102 may be configured to attach or affix to a picatinny retail attached to a firearm. In certain examples, mount 102 may be configured to attach or affix to a weapon such as a compound bow, crossbow, or pistol. In some examples, the mount may be modified to be compatible with a weaver mount, a dovetail mount, offset mount, quick detach mounts, or other type of rail mount or related systems. The mount 102 may include sidewalls 110. The mount 102 may include at least two socket head cap screws 112 that are inserted into screw head cylinders 113 shown in dotted lines in FIG. 1. The mount 102 may also include socket head cap screw 111 that may be positioned in the screw head cylinders 113 of sidewalls 110. Riser 104 may be positioned between mount 102 sidewalls 110 and may include adapter plate 106. Adapter plate 106 may be machined as an integral component of riser 104. In other examples, riser 104 and adapter plate 106 may be formed or machined as separate components and affixed to each other by welding or by mechanical means such as screw, bolt, nut, pin, combinations thereof, etc. The components, to include the mount 102, riser 104, and adapter plate 106 may be formed of metals, metal alloys, polymers, or combinations thereof.

Figure 2:
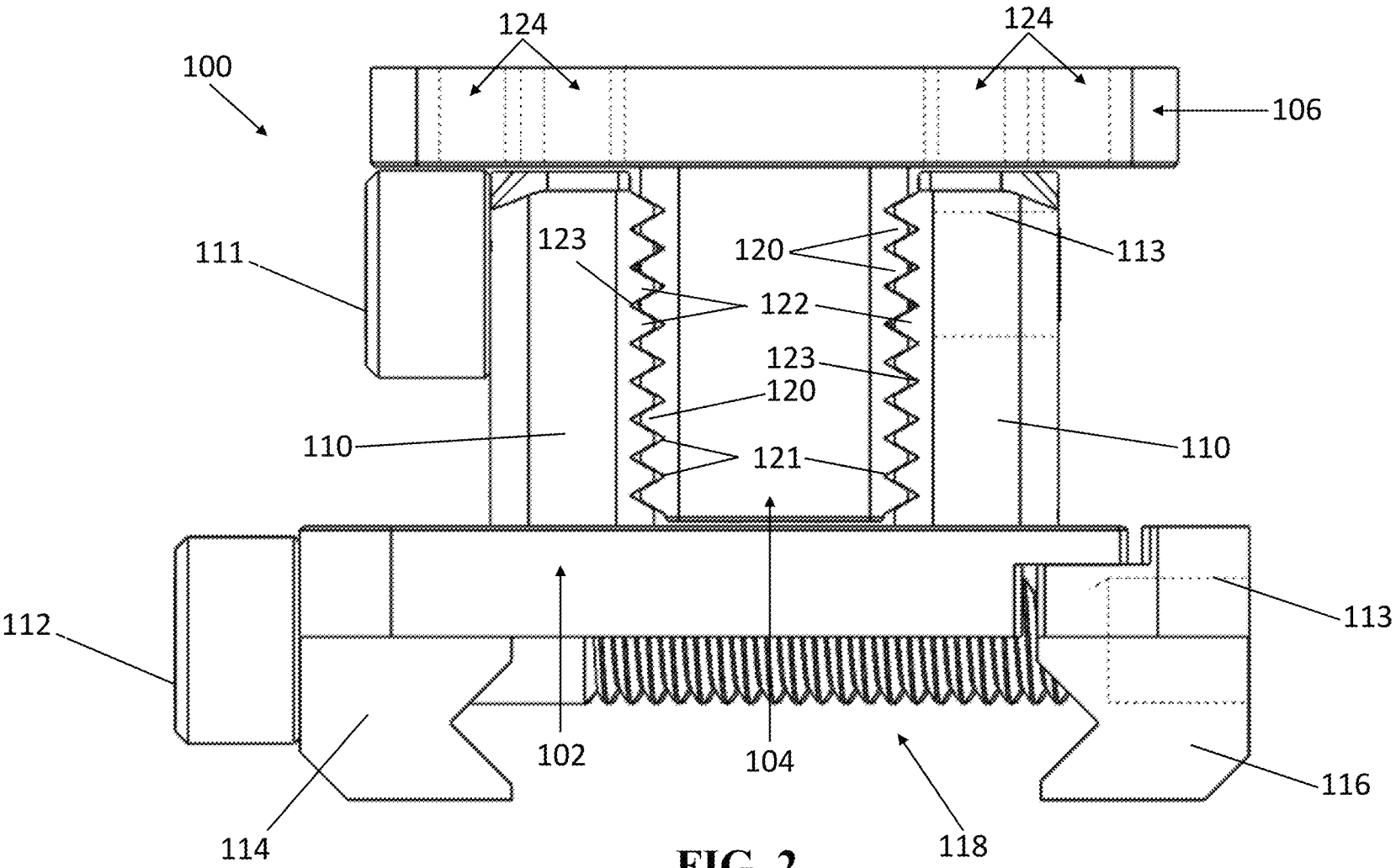
FIG. 2 is a front view of an adjustable riser mount system of FIG. 1.

FIG. 2 illustrates a front view of the example adjustable riser mount system 100 of FIG. 1. Mount 102 may include fixed clamp 114 and adjustable clamp 116. Clamps 114 and 116 may be formed of metals, metal alloys, polymers, or combinations thereof. Clamps 114 and 116 may be adjoined and engaged with socket head cap screws 112 via screw cylinders 113. Socket head cap screws 112 may be tightened thereby displacing movable claim 116 towards fixed clamp 114 and into a closed or locked position. Socket head cap screws 112 may be loosened thereby displacing movable claim 116 away from fixed clamp 114 and into an open position or a detached configuration. Mount 102 may be placed on a firearm accessory rail and tightened to a closed or secured position via socket head cap screws 112. Clamps 114 and 116 may include a dovetail opening 118, as shown in FIG. 2, to allow the mount to be slid on to a compatible accessory rail, or over the accessory rail if the movable clamp 116 is in an open position wide enough (or detached configuration) to allow placing over the width of the accessory rail. In some examples, socket head cap screws 112 and/or 111 may be fully removable from screw cylinders 113. In other examples, the socket head cap screws 112 and/or 111 may be machined to remain permanently affixed to screw cylinders 113 to prevent the loss of a screw. In another example, movable clamp 116 may be removed from the mount 102. In other examples, movable clamp 116 may be permanently affixed and unremovable from mount 102.

As also shown in FIG. 2, riser 104 may include a plurality of teeth or serrations 120 formed and positioned on the outer walls of riser 104. In some examples, the riser 104 may include at least 1, 2, 3, 4, 5, 6, 7, 8, 9, or 10 sets of teeth 120 on each outer wall of the riser 104. The number, size, spacing and shape of the plurality of teeth 120 may vary. Riser 104 may also include a plurality of grooves 121 formed and positioned on the outer walls of riser 104. In some examples, riser 104 may include, for example, at least, greater than, less than, equal to, or any number in between about 1, 2, 3, 4, 5, 6, 7, 8, 9, or 10 sets of grooves 121 on the outer walls of riser 104. The number, size, spacing and shape of the plurality of grooves 121 may vary. Riser teeth 120 and grooves 121 may be configured to removably engage mount sidewall grooves 123 and mount sidewall teeth or serrations 122 respectively. The plurality of mount sidewall teeth 122 and grooves 123 may be positioned on the inner portion of mount sidewalls 110. In some examples, the sidewalls 110 may include, for example, at least, greater than, less than, equal to, or any number in between about 1, 2, 3, 4, 5, 6, 7, 8, 9, or 10 sets of teeth 122. In other examples, the sidewalls 110 may include, for example, at least, greater than, less than, equal to, or any number in between about 1, 2, 3, 4, 5, 6, 7, 8, 9, or 10 sets of grooves 123. The respective sets of riser teeth 120 and grooves 121 may be configured to slidably engage the respective sets of sidewall grooves 123 and sidewall teeth 122. The engagement may be similar to a tongue and groove type engagement. In some examples, riser 104 and adapter plate 106 may be slid either forward and/or aft to disengage and reengage the mount 102. In some examples, riser 104 and adapter plate 106 may be limited as to only slide either forward or aft to disengage or reengage the mount 102. Riser 104 and adapter plate 106 may be secured or locked into position via socket head cap screw 111. Adapter plate 106 may include a plurality of through holes 124 (shown in dotted lines) that may be configured to engage various mechanical securing means and/or optics.

Figure 3:
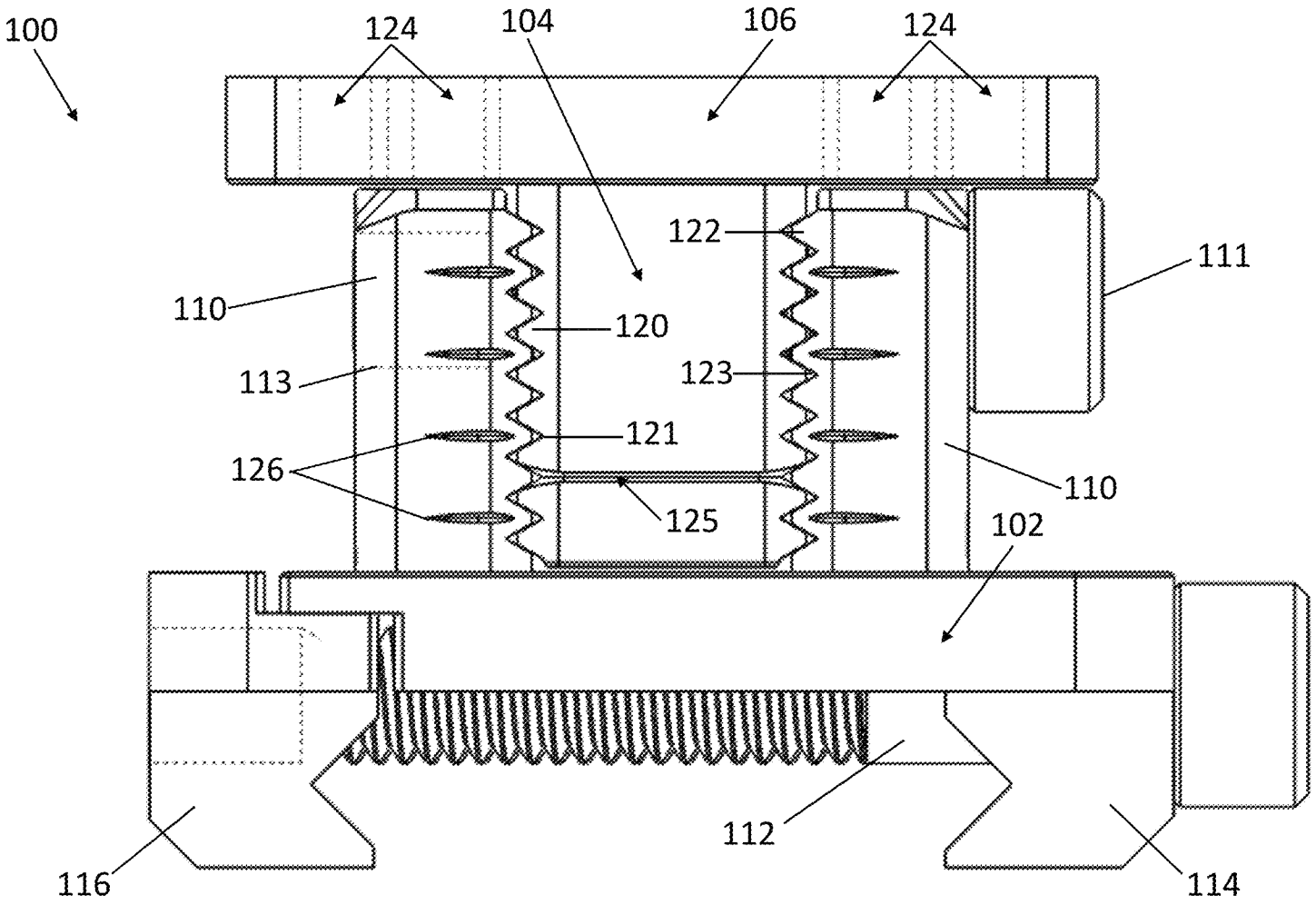
FIG. 3 is a rear view of an adjustable riser mount system of FIG. 1.

As shown in FIG. 3, riser 104 may also include vertical position marker 125 or other height indicator. Position marker 125 may be machined directly into the riser 104. In other examples, vertical position marker 125 may be painted or an enamel may be applied directly on the riser 104 to form position marker 125. In another example, position marker 125 may be machined into the riser 104 and may be painted or annotated with an enamel. In still other examples, the position marker 125 may include a low light enhancement such as a tritium marker or coating, glow in the dark indicator, or other fiber optic enhancement to improve low light visibility. Sidewalls 110 of mount 102 may extend perpendicular to the mount clamp 114 and/or mount clamp 116. In some examples, sidewalls 110 of mount 102 may be affixed to mount clamp 116. In still other examples, sidewalls 110 of mount 102 may be integrally formed with clamp 114. In another example, sidewalls 110 may be formed or machined as separate components and affixed to the clamp 114 by welding or by mechanical means such as screw, bolt, nut, pin, combinations thereof. Sidewalls 110 may also be positioned perpendicular to adapter plate 106. In some examples, adapter plate 106 may contact the top of the sidewalls 110 when the riser 104 is set in the lowest vertical position. In other examples, a small gap may be present between the bottom of the adapter plate 106 and the top of the sidewalls 110 when the riser 104 is set in the lowest vertical position. Sidewalls 110 may include height indicators or tic marks 126 positioned on the rear side of the sidewalls 110 that are visible to a shooter looking through the optic. In some examples, the sidewalls 110 may include a plurality of height indicators 126. In other examples, the sidewalls 110 may include at least four-pairs of height indicators 126. In still other examples, the sidewalls 110 may include, for example, at least, greater than, less than, equal to, or any number in between about 1, 2, 3, 4, 5, 6, 7, 8, 9, or 10 pairs of height indicators 126. In one example, the height indicators 126 may be machined into the sidewall 110 and may be painted or annotated with an enamel. In still other examples, the height indicators 126 may include a low light enhancement such as a tritium marker, glow in the dark indicator, or other fiber optic enhancement to improve low light visibility.

Riser 104 may be adjusted in a vertical plane to raise or lower an optic mounted on adapter plate 106 by loosening and removing socket head cap screw 111 from the mount sidewalls 110 and screw cylinder 113. Riser 104 and adapter plate 106 may be removed from the mount 102 by sliding forward or aft of the sidewalls 110. Riser 104 may then be adjusted using position marker 125 and height indicators/tic marks 126 to align riser 104 in the desired vertical position. Riser teeth 120 and grooves 121 may be aligned with sidewall grooves 123 and sidewall teeth 122, with the assistance of position marker 125 and tic marks 126. Upon alignment, the riser may be slid into place and secured by inserting and tightening socket head cap screw 111.

Figure 4:
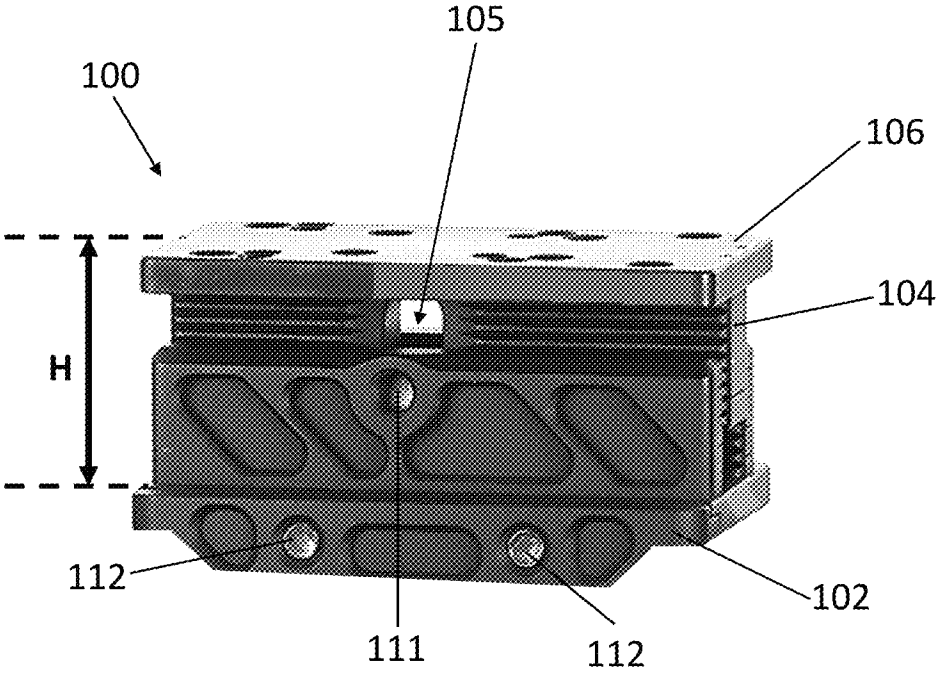
FIG. 4 is a rear-left perspective view of an alternative adjustable riser mount system disclosed herein.

FIG. 4 is a rear-left perspective view of an alternative adjustable riser mount system 100 disclosed herein. In some examples, riser 104 may include a vertical slot 105 configured to engage socket head cap screw 111. Slot 105 may be positioned in the center portion of the riser 104. In certain examples, slot 105 may extend from a bottom of adapter plate 106 to a bottom of riser 104. After riser 104 is slid into the desired vertical position, socket head cap screw 111 is inserted into screw cylinder 113 and through slot 105. Socket head cap screw 111 may be tightened securing riser 104 in the desired vertical position between mount 102 sidewalls 110. The disclosed configuration is superior to prior art methods and systems. The adjustable riser mount 100 and associated riser 104 may be secured in the desired position that minimizes movement in conventional adjustable systems. The tongue (i.e., teeth) and groove configuration and slot 105 affixing riser in place via socket head cap screw 111 provides unexpected improvements in stability and minimization of movement. Riser 104 and adapter plate 106 may be adjusted in a vertical plan as annotated in FIG. 4 by height H. Vertical height H may be, for example, at least, greater than, less than, equal to, or any number in between about 1.0 through 50.0 millimeters.

Figure 5:
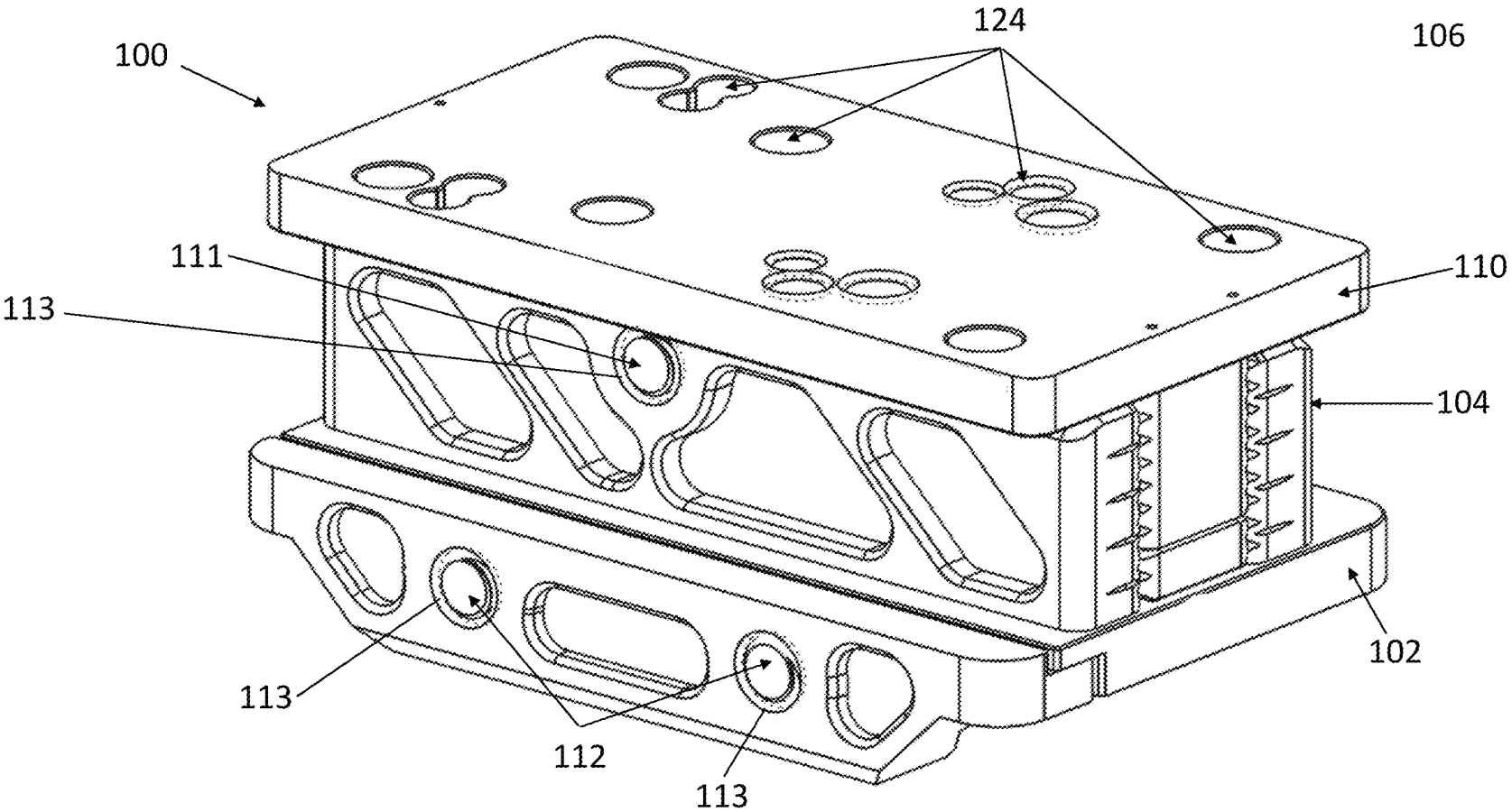
FIG. 5 is a rear-left perspective view of an adjustable riser mount system of FIG. 1.

FIG. 5 depicts a rear-left perspective view of the adjustable riser mount system 100. Adapter plate 106 may include a plurality of through holes 124 configured to engage various optic systems providing a nearly universal adapter plate. In some examples, through holes 124 may include, for example, at least, greater than, less than, equal to, or any number in between about 2 through 50 holes 124. In certain examples, the through hole 124 configuration will mirror the configuration on each side of the adapter plate 106 as shown in FIG. 5. The components of the adjustable riser mount system 100, to include socket head cap screws 111 and 113 may comprise metals, for example, 7075 aircraft aluminum, alloys, polymers, or combinations thereof. In other examples, mount 102 and sidewalls 110 may be formed or machined as separate components and affixed to each other by welding or by mechanical means such as screw, bolt, nut, pin, combinations thereof, etc. In some examples, mount 102 and sidewalls 110 may be formed or machined as integrated components.

The foregoing has been presented for purposes of example. The foregoing is not intended to be exhaustive or to limit features to the precise form disclosed. The examples discussed herein were chosen and described in order to explain principles and the nature of various examples and their practical application to enable one skilled in the art to use these and other implementations with various modifications as are suited to the particular use contemplated. The scope of this disclosure encompasses, but is not limited to, any and all combinations, subcombinations, and permutations of structure, operations, and/or other features described herein and in the accompanying drawing figures.

Although examples are described above, features and/or steps of those examples may be combined, divided, omitted, rearranged, revised, and/or augmented in any desired manner. Various alterations, modifications, and improvements will, in view of the foregoing disclosure, readily occur to those skilled in the art. Such alterations, modifications, and improvements are intended to be part of this description, though not expressly stated herein, and are intended to be within the spirit and scope of the disclosure. Accordingly, the foregoing description is by way of example only, and is not limiting.

What is claimed is:

1. A riser mount system comprising:

a mount configured to engage a picatinny rail;

a riser movably engaged with the mount, wherein the riser comprises a vertical slot positioned in a center portion of the riser and configured to engage a fastener, wherein the riser is configured to adjust vertically; and an adapter plate affixed to the riser, wherein the adapter plate is configured to removably engage an optic, wherein the vertical slot extends from a bottom of the adapter plate to a bottom of the riser.

2. The system of claim 1, wherein the mount further comprises a base and a first and second sidewall, wherein the first and second sidewalls are positioned perpendicular to the base, and wherein the first and second sidewalls comprise a first plurality of teeth.

3. The system of claim 2, wherein the riser further comprises a second plurality of teeth configured to engage the mount first plurality of teeth.

4. The system of claim 1, wherein the mount is a polymer, a metal, or an alloy.

5. The system of claim 1, wherein the riser is a polymer, a metal, or an alloy.

6. The system of claim 1, wherein the adapter plate is a polymer, a metal, or an alloy.

7. An optic comprising the system of claim 1.

8. The system of claim 7, wherein the optic is configured to removably engage the adapter plate.

9. A weapon comprising the system of claim 1.

10. The system of claim 9, wherein the weapon is a firearm.

11. An adjustable riser comprising:

an adapter plate configured to removably engage an optic; and a riser base configured to movably engage a mount, wherein the adapter plate is affixed to the riser base, wherein the adapter plate is positioned perpendicular to the riser base, wherein the riser base comprises a vertical slot positioned in a center portion of the mount, wherein the vertical slot extends from a bottom of the adapter plate to a bottom of the riser, and wherein the riser base is configured to movably adjust in a vertical plane.

12. The adjustable riser of claim 11, wherein the adapter plate or the riser base is a polymer, a metal, or an alloy.

13. The adjustable riser of claim 11, wherein the adapter plate or the riser base comprise 7075 aircraft aluminum.

14. The adjustable riser of claim 11, wherein the riser base includes a plurality of teeth configured to engage the mount.

15. The adjustable riser of claim 14, wherein the mount further includes a plurality of grooves configured to engage the riser base plurality of teeth.

16. A weapon comprising the adjustable riser of claim 11.

17. A firearm comprising the adjustable riser of claim 11.

18. An optic comprising the adjustable riser of claim 11.

19. A method of forming a riser mount system comprising:

forming a mount comprising a first plurality of teeth;

forming a riser comprising a second plurality of teeth and a vertical slot positioned in a center portion of the riser; and forming an adapter plate affixed to the riser, wherein the mount is configured to engage a picatinny rail, wherein the adapter plate is configured to removably engage an optic, wherein the vertical slot extends from a bottom of the adapter plate to a bottom of the riser, wherein the first plurality of teeth are configured to removably engage the second plurality of teeth, wherein the riser is configured to adjust vertically, and wherein the mount, the riser, or the adapter plate comprise a polymer, a metal, or an alloy.

* * * * *